US008344950B2

(12) United States Patent
Su

(10) Patent No.: US 8,344,950 B2
(45) Date of Patent: Jan. 1, 2013

(54) DUAL-LOOP ANTENNA AND MULTI-FREQUENCY MULTI-ANTENNA MODULE

(75) Inventor: Saou-Wen Su, Keelung (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 338 days.

(21) Appl. No.: 12/696,358

(22) Filed: Jan. 29, 2010

(65) Prior Publication Data

US 2011/0063180 A1 Mar. 17, 2011

(30) Foreign Application Priority Data

Sep. 15, 2009 (CN) ..... 2009 1 0175940

(51) Int. Cl.
*H01Q 1/38* (2006.01)

(52) U.S. Cl. ..... 343/700 MS; 343/742; 343/867

(58) Field of Classification Search ..... 343/700 MS, 343/741, 742, 866, 867
See application file for complete search history.

(56) References Cited

U.S. PATENT DOCUMENTS

| | | | | |
|---|---|---|---|---|
| 6,166,694 | A * | 12/2000 | Ying | 343/702 |
| 6,198,439 | B1 * | 3/2001 | Dufrane et al. | 343/700 MS |
| 6,639,560 | B1 * | 10/2003 | Kadambi et al. | 343/700 MS |
| 6,911,944 | B2 * | 6/2005 | Sekine et al. | 343/702 |
| 2007/0008222 | A1 * | 1/2007 | Wang et al. | 343/700 MS |

* cited by examiner

*Primary Examiner* — Hoanganh Le
(74) *Attorney, Agent, or Firm* — Li&Cai Intellectual Property (USA) Office

(57) ABSTRACT

A dual-loop antenna includes a grounding unit, a shorting unit, a feeding unit, a first loop radiating unit and a second loop radiating unit. The shorting unit has at least one shorting pin disposed on the grounding unit. The feeding unit has at least one feeding pin separated from the shorting pin by a predetermined distance and suspended above the grounding unit at a predetermined distance. The first loop radiating unit is disposed above the grounding unit at a predetermined distance. The first loop radiating unit has two ends respectively electrically connected to the shorting unit and the feeding unit. The second loop radiating unit is disposed above the grounding unit at a predetermined distance and around the first loop radiating unit. The second loop radiating unit has two ends respectively electrically connected to the shorting unit and the feeding unit.

20 Claims, 9 Drawing Sheets

DUAL-LOOP ANTENNA AND MULTI-FREQUENCY MULTI-ANTENNA MODULE

BACKGROUND OF THE INVENTION

1. Field of the Invention

The present invention relates to a multi-frequency multi-antenna module, in particular, to a dual-loop antenna and a multi-frequency multi-antenna module for generating good antenna performance.

2. Description of Related Art

Wireless LAN or 802.11a/b/g/n access-point antennas of the prior art are almost of external antenna structure. Common dipole antennas have a plastic or rubber sleeve covering thereon. In general, the dipole antenna is a single-band antenna for 2.4 GHz operation band or a dual-band antenna for 2.4/5 GHz operation band. The height of the dipole antenna is triple the thickness of the wireless broadband router/hub device, and one part of the dipole antenna is disposed on a side of the router and the rest of the dipole antenna is protruding from the top housing of the router. However, the protruded part of the dipole antenna can easily be vandalized by outside force and also occupies space, which deteriorates the aesthetic appeal of the product, especially for the multi-antenna system.

However, the above-mentioned prior art has the following common defects: 1. The traditional dipole antenna needs to use the plastic or rubber sleeve covering around the antenna, so that the cost is increased; 2. The antenna of the prior art cannot be fully hidden in the router, so that the aesthetic appeal of the product that uses the antenna of the prior art is deteriorated.

In addition, when 2.4/5.2/5.8 GHz wireless LAN or 802.11a/b/g/n wireless standards are applied to a built-in antenna design, the design of the antenna can be chosen from a PIFA antenna, a shorted-monopole antenna or a patch antenna. In general, the maximum antenna gains of the built-in PIFA antenna or shorted-monopole antenna are about 3 dBi and 4 dBi at 2.4 GHz and 5.2/5.8 GHz band, respectively. And the broadside radiation of the radiation pattern is much less common in the PIFA antenna or shorted-monopole antenna. It is necessary to use the patch antenna or the microstrip antenna in order to achieve high gain antenna (the maximum antenna gain needs to be over at least 6 dBi at 2.4 GHz and 5.2/5.8 GHz bands). Because the radiation pattern of the patch antenna or microstrip antenna is broadside radiation that can show directive radiation pattern, the maximum antenna gain of the patch antenna or microstrip antenna is larger than that of the PIFA antenna or shorted-monopole antenna. However, the patch antenna or microstrip antenna is composed of two structure layers, one structure layer is an antenna radiating body and another structure layer is an antenna grounding plane. In addition, the antenna radiating body needs to occupy a lot of space, and the patch antenna or microstrip antenna is an unbalanced structure, so that the patch antenna or microstrip antenna is affected easily by effects of grounding plane.

SUMMARY OF THE INVENTION

In view of the aforementioned issues, the present invention provides a dual-loop antenna and a multi-frequency multi-antenna module. The present invention not only has some advantages such as small size, low profile, good isolation and good radiation properties, but also can replace the external dual-band access-point antenna of the prior art for 2.4/5 GHz WLAN operation without using extra diplexer. In addition, the multi-frequency multi-antenna module of the present invention can be hidden in the router to enhance the appearance of the product that uses the dual-loop antenna.

To achieve the above-mentioned objectives, the present invention provides a dual-loop antenna, including: a grounding unit, a shorting unit, a feeding unit, a first loop radiating unit and a second loop radiating unit. The shorting unit has at least one shorting pin disposed on the grounding unit. The feeding unit has at least one feeding pin separated from the at least one shorting pin by a predetermined distance and suspended above the grounding unit at a predetermined distance. The first loop radiating unit is disposed above the grounding unit at a predetermined distance. The first loop radiating unit has two ends respectively electrically connected to the shorting unit and the feeding unit, and the first loop radiating unit provides a first operating frequency band. The second loop radiating unit is disposed above the grounding unit at a predetermined distance and around the first loop radiating unit. The second loop radiating unit has two ends respectively electrically connected to the shorting unit and the feeding unit, and the second loop radiating unit provides a second operating frequency band.

To achieve the above-mentioned objectives, the present invention provides a multi-frequency multi-antenna module, including: a grounding unit and a plurality of dual-loop structures. The dual-loop structures surroundingly face a geometric center of the grounding unit and are disposed on the grounding unit. Two center lines of every two adjacent dual-loop structures intersect at the geometric center of the grounding unit to form an included angle and each of the included angles has substantial the same measure. Each dual-loop structure includes a shorting unit, a feeding unit, a first loop radiating unit and a second loop radiating unit. The shorting unit has at least one shorting pin disposed on the grounding unit. The feeding unit has at least one feeding pin separated from the at least one shorting pin by a predetermined distance and suspended above the grounding unit at a predetermined distance. The first loop radiating unit is disposed above the grounding unit at a predetermined distance. The first loop radiating unit has two ends respectively electrically connected to the shorting unit and the feeding unit, and the first loop radiating unit provides a first operating frequency band. The second loop radiating unit is disposed above the grounding unit at a predetermined distance and around the first loop radiating unit. The second loop radiating unit has two ends respectively electrically connected to the shorting unit and the feeding unit, and the second loop radiating unit provides a second operating frequency band.

To achieve the above-mentioned objectives, the present invention provides a multi-frequency multi-antenna module installed in an antenna system housing, including: a grounding unit and a plurality of dual-loop structures. The dual-loop structures surroundingly face a geometric center of the grounding unit and are disposed on the grounding unit. Two center lines of every two adjacent dual-loop structures intersect at the geometric center of the grounding unit to form an included angle and each of the included angles has substantial the same measure. Each dual-loop structure includes a shorting unit, a feeding unit, a first loop radiating unit and a second loop radiating unit. The shorting unit has at least one shorting pin disposed on the grounding unit. The feeding unit has at least one feeding pin separated from the at least one shorting pin by a predetermined distance and suspended above the grounding unit at a predetermined distance. The first loop radiating unit is disposed above the grounding unit at a predetermined distance. The first loop radiating unit has two ends respectively electrically connected to the shorting unit and the feeding unit, and the first loop radiating unit provides a first operating frequency band. The second loop radiating unit is disposed above the grounding unit at a predetermined distance and around the first loop radiating unit. The second loop radiating unit has two ends respectively electrically connected to the shorting unit and the feeding unit, and the second loop radiating unit provides a second operating frequency band. Consequently, the grounding unit and the dual-loop structures are enclosed by the antenna system housing.

Therefore, the present invention has the following advantages:

1. In the embodiments of the present invention, the present invention uses three independent dual-loop structures S, and each dual-loop structure S is composed of one first loop radiating unit and a second loop radiating unit disposed around the first loop radiating unit. In addition, the first loop radiating unit can operate in the 5.2/5.8 GHz band, and the second loop radiating unit can operate in the 2.4 GHz band.

2. In the embodiments of the present invention, the first loop radiating unit and the second loop radiating unit of each dual-loop structure S can be bent to reduce the whole height of the multi-frequency multi-antenna module of the present invention. Hence, the multi-frequency multi-antenna module of the present invention can be hidden in the antenna system product, such as a router or a hub, so as to enhance the appearance of the product that uses the multi-frequency multi-antenna module.

3. The present invention can obtain good impedance matching (2:1 VSWR or 10 dB return loss) for WLAN operation in the 2.4 and 5.2/5.8 GHz bands by adjusting the distance between the first loop radiating unit and the second loop radiating unit of each dual-loop structure and by controlling the distance between the feeding unit and the shorting unit of each dual-loop structure.

4. Because the shorting unit of each dual-loop structure is adjacent to the feeding unit of each dual-loop structure, the mutual coupling between every two dual-loop structures with different or even the same antenna operating frequencies is substantially decreased and the isolation can remain under −15 dB.

5. Each dual-loop structure can be of a one-wavelength loop structure, which is a balanced structure that can substantially mitigate the surface currents excited on the antenna grounding plate or system grounding plate. Therefore, the grounding plate such as the grounding unit of the present invention can act as a reflector, so that the directivity of the antenna radiation is large to obtain high antenna gain (the maximum antenna gain can be about 7 dB).

In order to further understand the techniques, means and effects the present invention takes for achieving the prescribed objectives, the following detailed descriptions and appended drawings are hereby referred, such that, through which, the purposes, features and aspects of the present invention can be thoroughly and concretely appreciated; however, the appended drawings are provided solely for reference and illustration, without any intention that they be used for limiting the present invention.

DETAILED DESCRIPTION OF THE PREFERRED EMBODIMENTS

The dual-loop antenna is defined as label M and the dual-loop structure is defined as label S both shown in the following descriptions. In addition, the dual-loop antenna M at least includes a grounding unit, a shorting unit, a feeding unit and two loop radiating units, and the dual-loop structure S at least includes a shorting unit, a feeding unit and two loop radiating units.

Figure 1A:
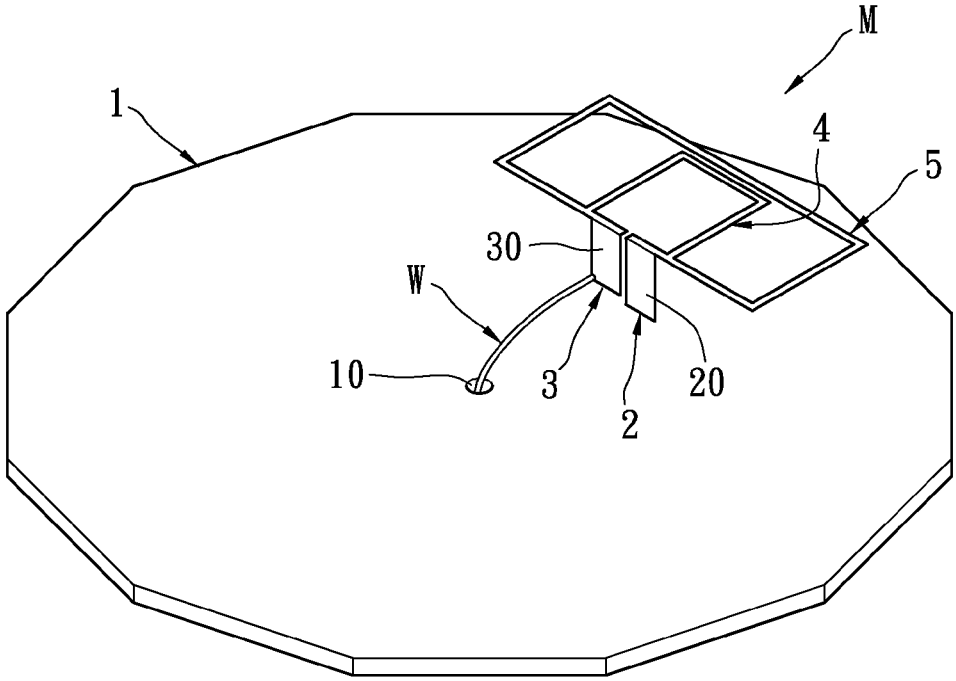
FIG. 1A is a perspective, schematic view of the dual-loop antenna according to the first embodiment of the present invention.
Figure 1B:
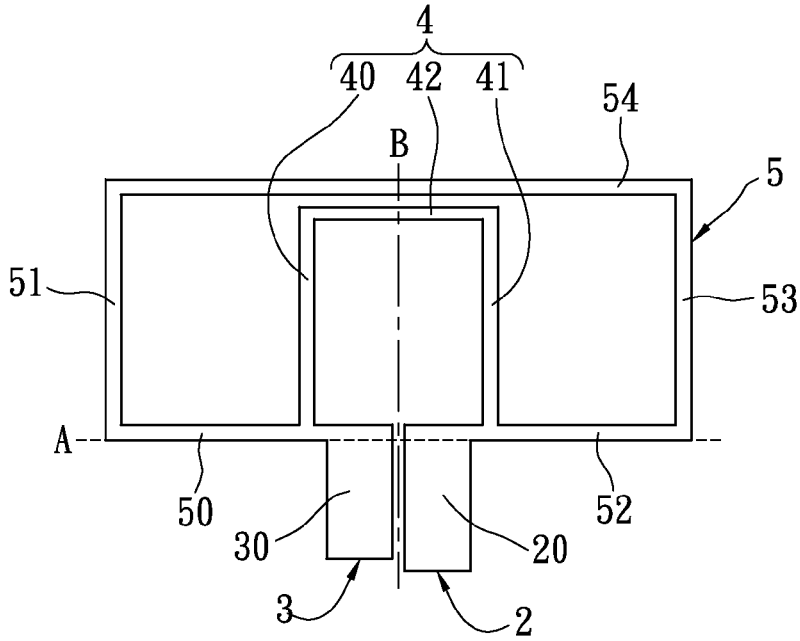
FIG. 1B is a front, schematic view of the dual-loop antenna without the grounding unit according to the first embodiment of the present invention, wherein the first loop radiating unit and the second loop radiating unit have not been bent yet.

Referring to FIGS. 1A and 1B, the first embodiment of the present invention provides a dual-loop antenna M, including: a grounding unit 1, a shorting unit 2, a feeding unit 3, a first loop radiating unit 4 and a second loop radiating unit 5. In addition, the grounding unit 1 can be a regular polygonal conductive plate (not shown), a circular conductive plate or any conductive plates with a predetermined shape, and the grounding unit 1 has a through hole 10 formed on a central portion thereof for ease of cable routing.

Moreover, the shorting unit 2 has at least one shorting pin 20 disposed on the grounding unit 1, and it means that the shorting pin 20 of the shorting unit 2 contacts the grounding unit 1. The feeding unit 3 has at least one feeding pin 30 separated from the shorting pin 20 by a predetermined distance and suspended above the grounding unit 1 at a predetermined distance, and it means that the feeding pin 30 of the feeding unit 3 does not touch the grounding unit 1 and is separated from the grounding unit 1. In addition, the shorting pin 20 of the shorting unit 2 and the feeding pin 30 of the feeding unit 3 are separated from each other by a predetermined distance to obtain good impedance matching.

Furthermore, the first loop radiating unit 4 and the second loop radiating unit 5 have not been bent yet as shown in FIG. 1B. After the first loop radiating unit 4 and the second loop radiating unit 5 are bent forwards by substantial 90 degrees along the dash-line A as shown in FIG. 1B, the finished first loop radiating unit 4 and the finished second loop radiating unit 5 are shown in FIG. 1A. For example, in the first embodiment, the first loop radiating unit 4 is divided into two portions by a center line B thereof and the two portions of the first loop radiating unit 4 are symmetrical, and the second loop radiating unit 5 is divided into two portions by a center line B thereof and the two portions of the second loop radiating unit 5 are symmetrical. In addition, the first loop radiating unit 4 and the second loop radiating unit 5 can be disposed on the same plane (it means the first loop radiating unit 4 and the second loop radiating unit 5 are substantially coplanar) or different planes (it means the first loop radiating unit 4 and the second loop radiating unit 5 are non-coplanar) according to different requirements. For example, the first loop radiating unit 4 and the second loop radiating unit 5 are disposed on the same plane in the first embodiment.

Besides, the first loop radiating unit 4 can provide a first operating frequency band (such as 5.2 GHz or 5.8 GHz band). The first loop radiating unit 4 is disposed above and substantially horizontal to the grounding unit 1 at a predetermined distance, and the first loop radiating unit 4 has two ends respectively electrically connected to the shorting unit 2 and the feeding unit 3. For example, in the first embodiment, the first loop radiating unit 4 has a first radiating portion 40 electrically connected to the feeding unit 3, a second radiating portion 41 electrically connected to the shorting unit 2, and a third radiating portion 42 electrically connected between one end of the first radiating portion 40 and one end of the second radiating portion 41.

In addition, the second loop radiating unit 5 can provide a second operating frequency band (such as 2.4 GHz band). The second loop radiating unit 5 is disposed above and substantially horizontal to the grounding unit 1 at a predetermined distance and around the first loop radiating unit 4, and the second loop radiating unit 5 has two ends respectively electrically connected to the shorting unit 2 and the feeding unit 3. For example, in the first embodiment, the second loop radiating unit 5 has a fourth radiating portion 50 parallel to the third radiating portion 42 and electrically connected to the feeding unit 3, a fifth radiating portion 51 extended outwards from the fourth radiating portion 50 and parallel to the first radiating portion 40, a sixth radiating portion 52 parallel to the third radiating portion 42 and electrically connected to the shorting unit 2, a seventh radiating portion 53 extended outwards from the sixth radiating portion 52 and parallel to the second radiating portion 41, and an eighth radiating portion 54 electrically connected between one end of the fifth radiating portion 51 and one end of the seventh radiating portion 53. Besides, the first, the second, the fifth and the seventh radiating portions (40, 41, 51, 53) are parallel to each other, and the third radiating portion (42) and the eighth radiating portion (54) are parallel to each other and separated from each other by a distance of 0.5~1.5 mm, which can be adjusted for better antenna impedance matching.

In other words, the two ends of the second loop radiating unit 5 are respectively contacted to the shorting unit 2 and the feeding unit 3 directly, and the two ends of the first loop radiating unit 4 are respectively electrically connected to the shorting unit 2 and the feeding unit 3 via the second loop radiating unit 5 indirectly.

Moreover, the dual-loop antenna M of the first embodiment further includes a signal wire W. Therein, one end of the signal wire W is electrically connected to the bottom side of the feeding pin 30, and another end of the signal wire W passes through the through hole 10, so that the signal wire W can be routed neatly by through the through hole 10. In addition, antenna signals received by the feeding pin 30 of the feeding unit 3 can be transmitted to a built-in PCB (not shown) of a router or a hub by using the signal wire W. Of course, the present invention can omit the through hole 10, so that the signal wire W can be attached to the top surface of the grounding unit 1 to facilitate the cable routing for the signal wire W.

Figure 2:
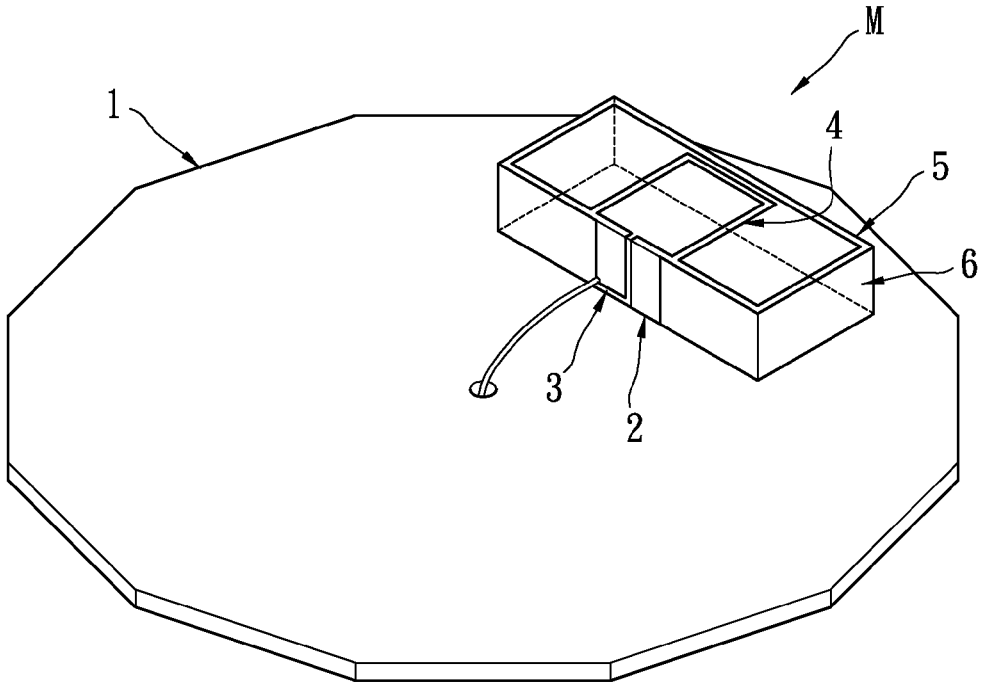
FIG. 2 is a perspective, schematic view of the dual-loop antenna according to the second embodiment of the present invention.

Referring to FIG. 2, the second embodiment of the present invention provides a dual-loop antenna M, including: a grounding unit 1, a shorting unit 2, a feeding unit 3, a first loop radiating unit 4, a second loop radiating unit 5 and an insulating body 6. Therein the insulating body 6 can be made of high dielectric constant material such as ceramic etc. The difference between the second embodiment and the first embodiment is that: in the second embodiment, the insulating body 6 is disposed on the grounding unit 1 and is located among the shorting unit 2, the feeding unit 3, the first loop radiating unit 4 and the second loop radiating unit 5. In addition, the shorting unit 2, the feeding unit 3, the first loop radiating unit 4 and the second loop radiating unit 5 are tightly adhered to an outer surface of the insulating body 6 to strengthen the structural strengths of the shorting unit 2, the feeding unit 3, the first loop radiating unit 4 and the second loop radiating unit 5.

Figure 3:
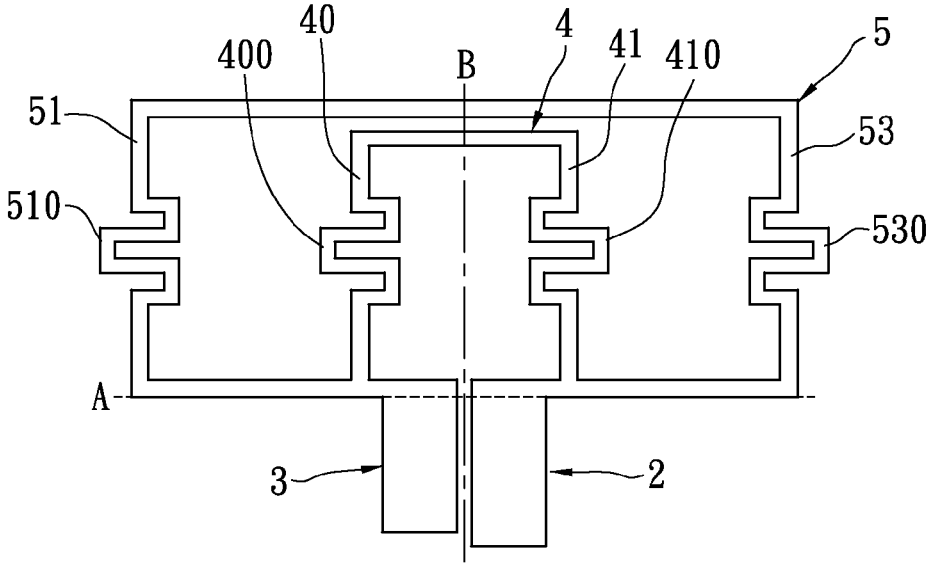
FIG. 3 is a front, schematic view of the dual-loop antenna without the grounding unit according to the third embodiment of the present invention, wherein the first loop radiating unit and the second loop radiating unit have not been bent yet.

Referring to FIG. 3, the third embodiment of the present invention provides a dual-loop antenna M, including: a grounding unit (not shown), a shorting unit 2, a feeding unit 3, a first loop radiating unit 4 and a second loop radiating unit 5. The first loop radiating unit 4 and the second loop radiating unit 5 have not been bent along the dash-line A yet and the shorting unit 2 has not been disposed on the grounding unit (the same as the state in FIG. 1B). According to the comparison between the third embodiment and the first embodiment, the major difference is that: in the third embodiment, the first radiating portion 40 has a first bending section 400, and the second radiating portion 41 has a second bending section 410 corresponding to the first bending section 400; The fifth radiating portion 51 has a fifth bending section 510, and the seventh radiating portion 53 has a seventh bending section 530 corresponding to the fifth bending section 510. In other words, the first bending section 400 of the first radiating portion 40 and the second bending section 410 of the second bending section 410 with respect to the center line B as a datum line are symmetrical with each other, and the fifth bending section 510 of the fifth radiating portion 51 and the seventh bending section 530 of the seventh radiating portion 53 with respect to the center line B as a datum line are symmetrical with each other as well.

Figure 4:
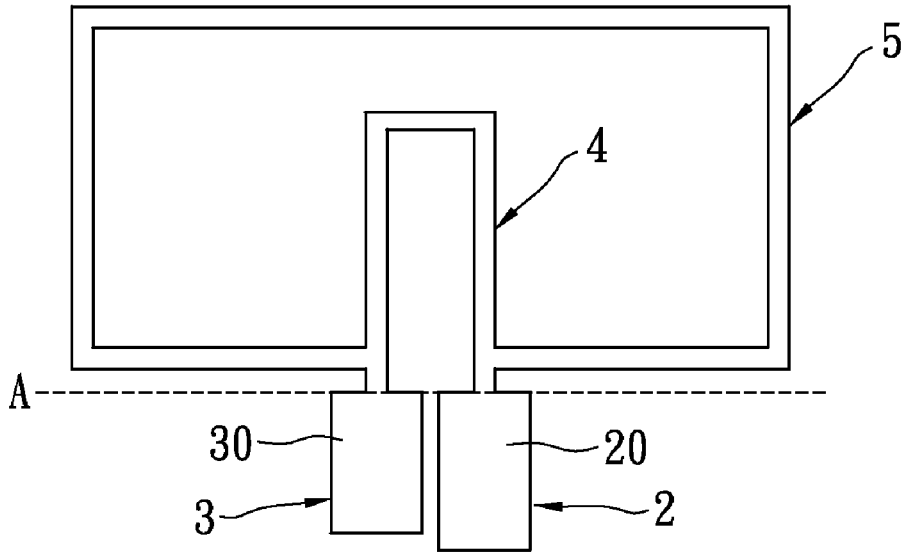
FIG. 4 is a front, schematic view of the dual-loop antenna without the grounding unit according to the fourth embodiment of the present invention, wherein the first loop radiating unit and the second loop radiating unit have not been bent yet.

Referring to FIG. 4, the fourth embodiment of the present invention provides a dual-loop antenna M, including: a grounding unit (not shown), a shorting unit 2, a feeding unit 3, a first loop radiating unit 4 and a second loop radiating unit 5. The first loop radiating unit 4 and the second loop radiating unit 5 have not been bent along the dash-line A yet and the shorting unit 2 has not been disposed on the grounding unit (the same as the state in FIG. 1B). In addition, the difference between the fourth embodiment and the first embodiment is that: in the fourth embodiment, the two ends of the first loop radiating unit 4 are respectively contacted to the shorting unit 2 and the feeding unit 3 directly, and the two ends of the second loop radiating unit 5 are respectively electrically connected to the shorting unit 2 and the feeding unit 3 via the first loop radiating unit 4 indirectly.

Figure 5:
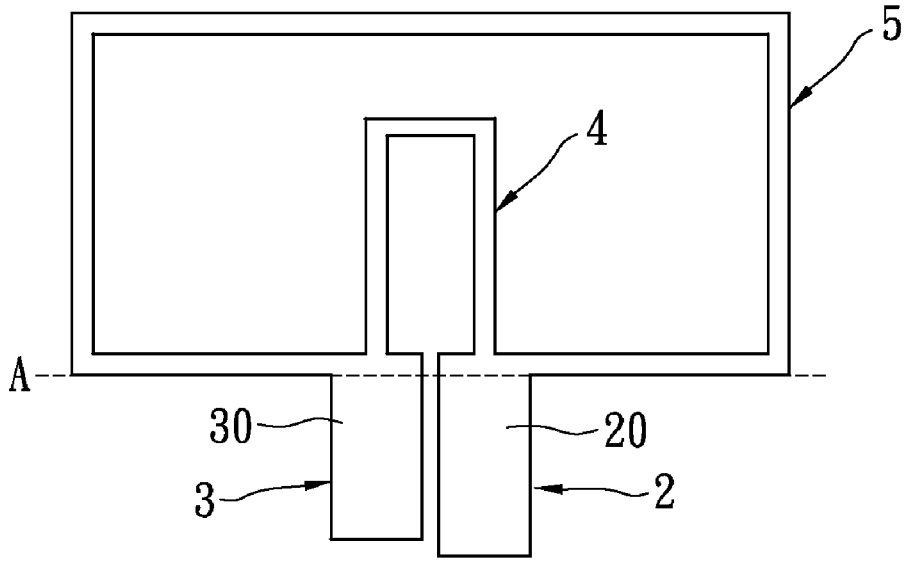
FIG. 5 is a front, schematic view of the dual-loop antenna without the grounding unit according to the fifth embodiment of the present invention, wherein the first loop radiating unit and the second loop radiating unit have not been bent yet.

Referring to FIG. 5, the fifth embodiment of the present invention provides a dual-loop antenna M, including: a grounding unit (not shown), a shorting unit 2, a feeding unit 3, a first loop radiating unit 4 and a second loop radiating unit 5. The first loop radiating unit 4 and the second loop radiating unit 5 have not been bent along the dash-line A yet and the shorting unit 2 has not been disposed on the grounding unit (the same as the state in FIG. 1B). As per the comparison between the fifth embodiment and the first embodiment, the major difference is that: in the fifth embodiment, the two ends of the first loop radiating unit 4 are respectively contacted to the shorting unit 2 and the feeding unit 3 directly, and the two ends of the second loop radiating unit 5 are respectively contacted to the shorting unit 2 and the feeding unit 3 directly.

Figure 6:
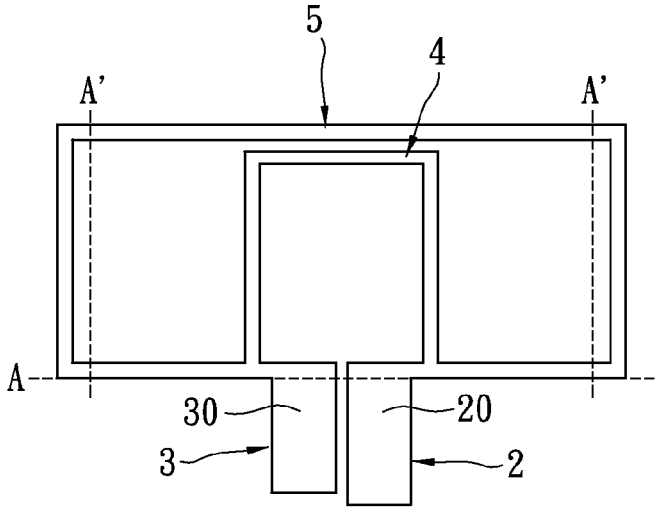
FIG. 6 is a front, schematic view of the dual-loop antenna without the grounding unit according to the sixth embodiment of the present invention, wherein the first loop radiating unit and the second loop radiating unit have not been bent yet.

Referring to FIG. 6, the sixth embodiment of the present invention provides a dual-loop antenna M, including: a grounding unit (not shown), a shorting unit 2, a feeding unit 3, a first loop radiating unit 4 and a second loop radiating unit 5. The first loop radiating unit 4 and the second loop radiating unit 5 have not been bent along three dash-lines (A, A') yet and the shorting unit 2 has not been disposed on the grounding unit (the same as the state in FIG. 1B). As per the comparison between the sixth embodiment and the first embodiment, the major difference is that: in the sixth embodiment, the two opposite sides of the second loop radiating unit 5 can bent downwards symmetrically along the two dash-lines A' to decrease the whole length and overall volume of the second loop radiating unit 5.

However, the above-mentioned designs regarding the first loop radiating unit 4 and the second loop radiating unit 5 are merely provided for reference and illustration, without any intention to be used for limiting the present invention. The features of at least two loops electrically connected between the shorting unit 2 and the feeding unit 3 and one loop disposed around another loop are protected in the present invention. Various equivalent changes, alternations or modifications based on the present invention are all consequently viewed as being embraced by the scope of the present invention.

Figure 7:
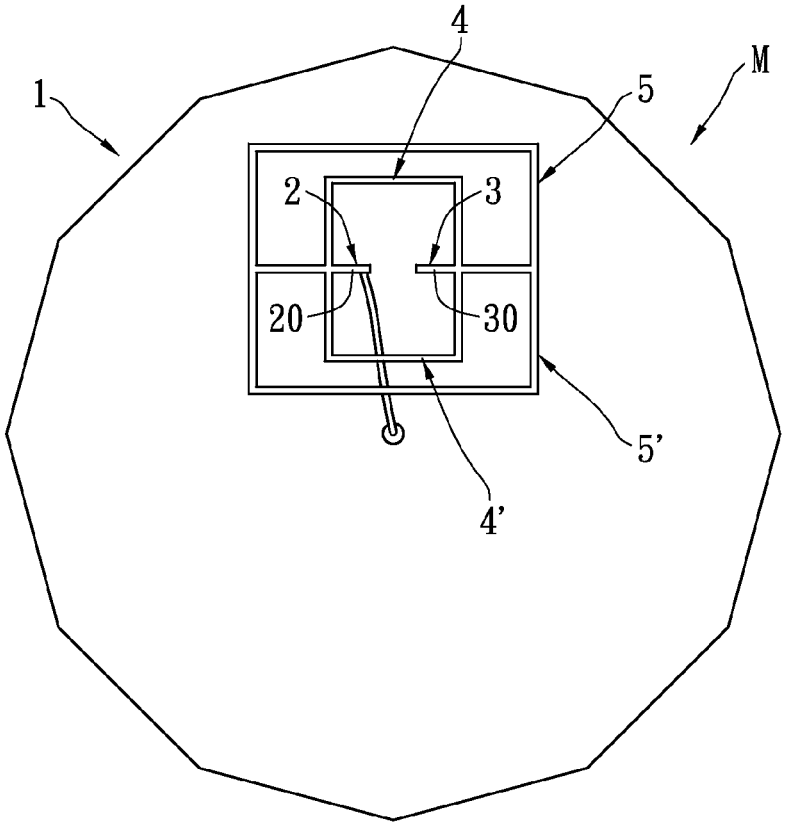
FIG. 7 is a top, schematic view of the dual-loop antenna according to the seventh embodiment of the present invention.

Of course, the present invention can use more than one dual-loop structure at the same time, and each dual-loop structure is composed of two loop radiating units. For example, referring to FIG. 7, the seventh embodiment of the present invention provides a dual-loop antenna M, including: a grounding unit 1, a shorting unit 2, a feeding unit 3, a first loop radiating unit 4, a second loop radiating unit 5, a third loop radiating unit 4' and a fourth loop radiating unit 5'. As per the comparison between the seventh embodiment and the first embodiment, the primary difference is that: the seventh embodiment provides two new loop radiating units as the third loop radiating unit 4' and the fourth loop radiating unit 5', so that the dual-loop antenna M of the seventh embodiment is composed of two dual-loop structures. In other words, the first loop radiating unit 4 and the second loop radiating unit 5 are mated with each other to form one dual-loop structure, and the third loop radiating unit 4' and the fourth loop radiating unit 5' are mated with each other to form another dual-loop structure. In this case, a quad-loop antenna is obtained.

Furthermore, the third loop radiating unit 4' is disposed above the grounding unit 1 at a predetermined distance. The third loop radiating unit 4' has two ends respectively electrically connected to the shorting unit 2 and the feeding unit 3, and the third loop radiating unit 4' corresponds to the first loop radiating unit 4. In addition, the fourth loop radiating unit 5' is disposed above the grounding unit 1 at a predetermined distance and around the third loop radiating unit 4'. The fourth loop radiating unit 5' has two ends respectively electrically connected to the shorting unit 2 and the feeding unit 3, and the fourth loop radiating unit 5' corresponds to the second loop radiating unit 5.

Figure 8A:
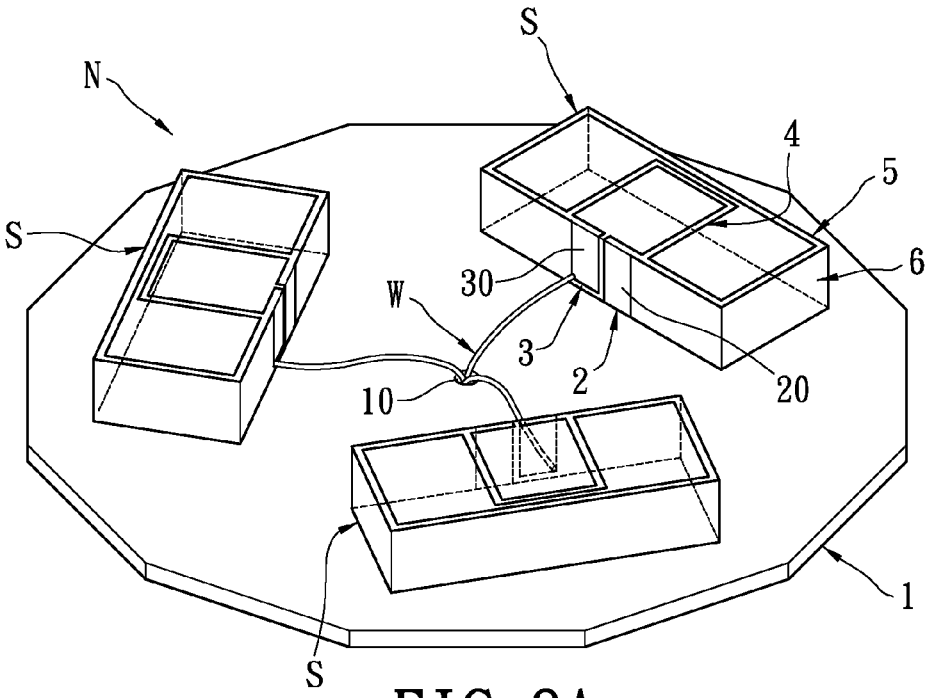
FIG. 8A is a perspective, schematic view of the multi-frequency multi-antenna module according to the present invention.
Figure 8B:
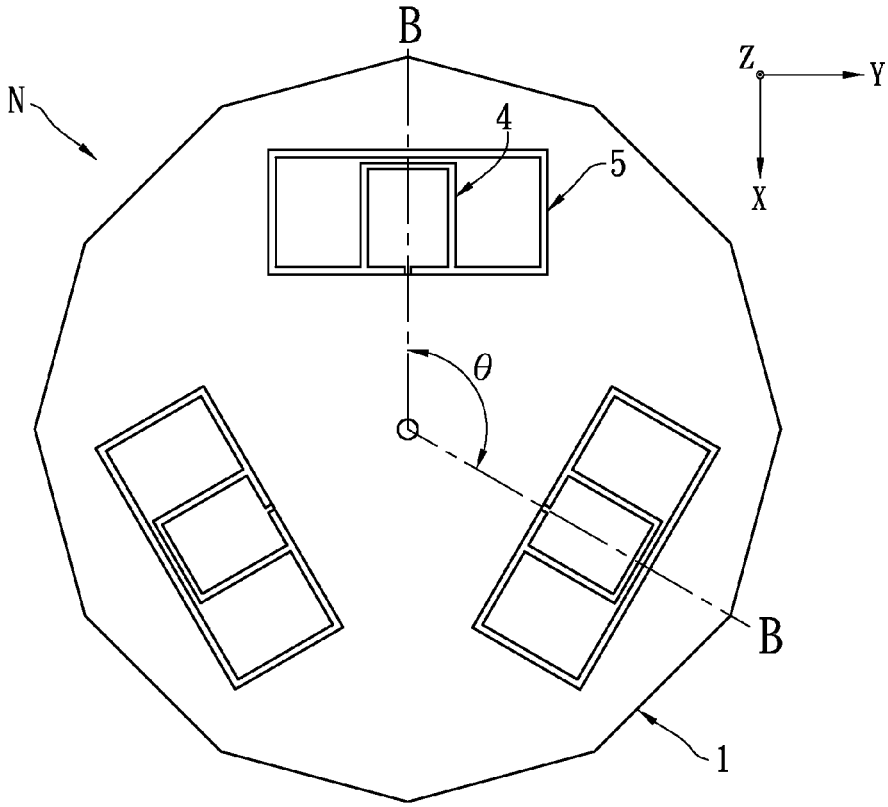
FIG. 8B is a top, schematic view of the multi-frequency multi-antenna module according to the present invention.

Referring to FIGS. 8A and 8B, the present invention provides a multi-frequency multi-antenna module N, including: a grounding unit 1 and a plurality of dual-loop structures S, and the dual-loop structures S surroundingly face a geometric center of the grounding unit 1 and are disposed on the grounding unit 1. For example, the through hole 10 at the center portion of the grounding unit 1 is defined as the geometric center of the grounding unit 1, and the dual-loop structures S disposed on the grounding unit 1 and around the through hole 10. In addition, the center line of each dual-loop structure S connecting to the geometric center of the grounding unit 1 is defined as label B, and each included angle θ constructed between two adjacent center lines B of every two adjacent dual-loop structures S has completely or almost the same measure.

Furthermore, each dual-loop structure S includes a shorting unit 2, a feeding unit 3, a first loop radiating unit 4 and a second loop radiating unit 5. Additionally, the dual-loop structures S are made of metal conductive plates by stamping (or line-cutting) and bending. In general, the bending angle can be a right angle, but is not merely limited thereto.

Moreover, each dual-loop structure S further includes an insulating body 6 that is disposed on the grounding unit 1, and the shorting unit 2, the feeding unit 3, the first loop radiating unit 4 and the second loop radiating unit 5 are tightly adhered to an outer surface of the insulating body 6 to strengthen the structural strengths of the shorting unit 2, the feeding unit 3, the first loop radiating unit 4 and the second loop radiating unit 5.

Besides, the descriptions of the shorting unit 2, the feeding unit 3, the first loop radiating unit 4 and the second loop radiating unit 5 are the same as the definition of the dual-loop antenna M shown in FIG. 1A, so that it is unnecessary to describe details again here.

Moreover, the multi-frequency multi-antenna module further includes a plurality of signal wires W respectively corresponding to the dual-loop structures S. In addition, the relationship between the signal wires W, the grounding unit 1 and the feeding unit 3 is that same as the definition of the dual-loop antenna M shown in FIG. 1A, so that it is unnecessary to describe details again here.

For example, referring to FIGS. 8A and 8B, the number of the dual-loop structures S is three, so that each included angle is 120 degrees. However, the above-mentioned number of the dual-loop structures S and the above-mentioned definition of each included angle θ that is formed between two adjacent center lines B of every two adjacent dual-loop structures S are only taken as examples for illustrations, and are not merely limited thereto.

Besides, the feeding unit 3 of each dual-loop structure S is adjacent to the shorting unit 2 of one adjacent dual-loop structure S, and the shorting unit 2 of each dual-loop structure S is adjacent to the feeding unit 3 of another adjacent dual-loop structure S. Hence, the above-mentioned pin alternating design can prevent every two adjacent shorting pins 20 (or feeding pins 30) from being interfered with each other.

Figure 9:
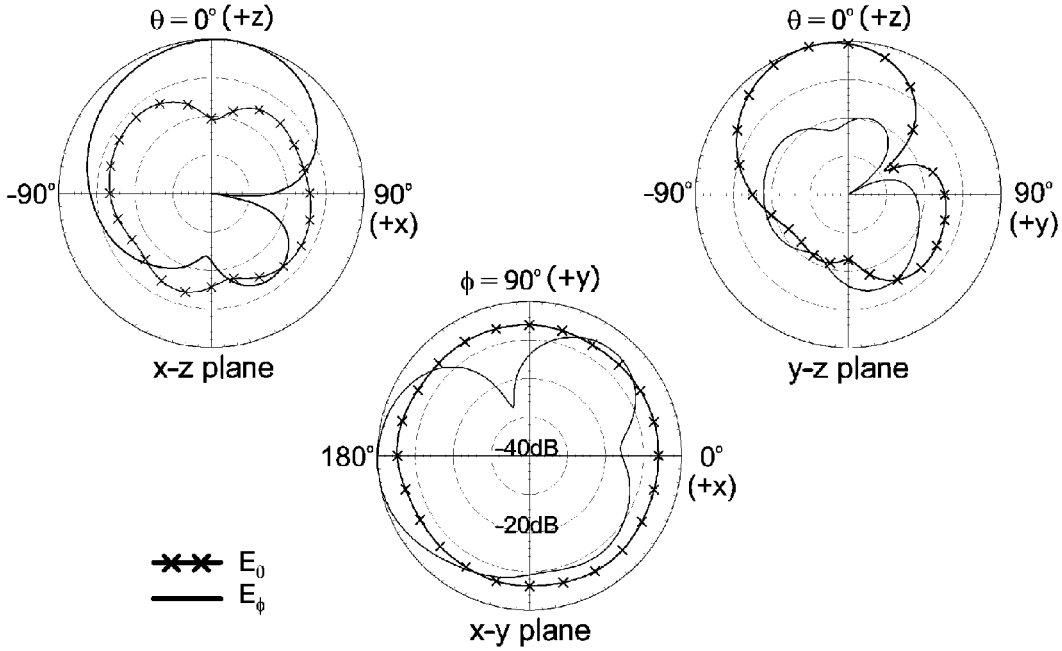
FIG. 9 shows radiation patterns of one dual-loop structure mated with the grounding unit at 2442 MHz in different planes (such as x-z plane, y-z plane and x-y plane) according to the present invention.

Referring to FIGS. 8B and 9, FIG. 9 shows measured results of 2D radiation patterns of one of the dual-loop structures S (the topmost dual-loop structure S in FIG. 8B) at 2442 MHz in different planes (such as x-z plane, y-z plane and x-y plane) according to the definition of the coordinate in FIG. 8B. From the results, directive radiation patterns are respectively shown in elevation planes of the x-z plane and y-z plane.

Figure 10:
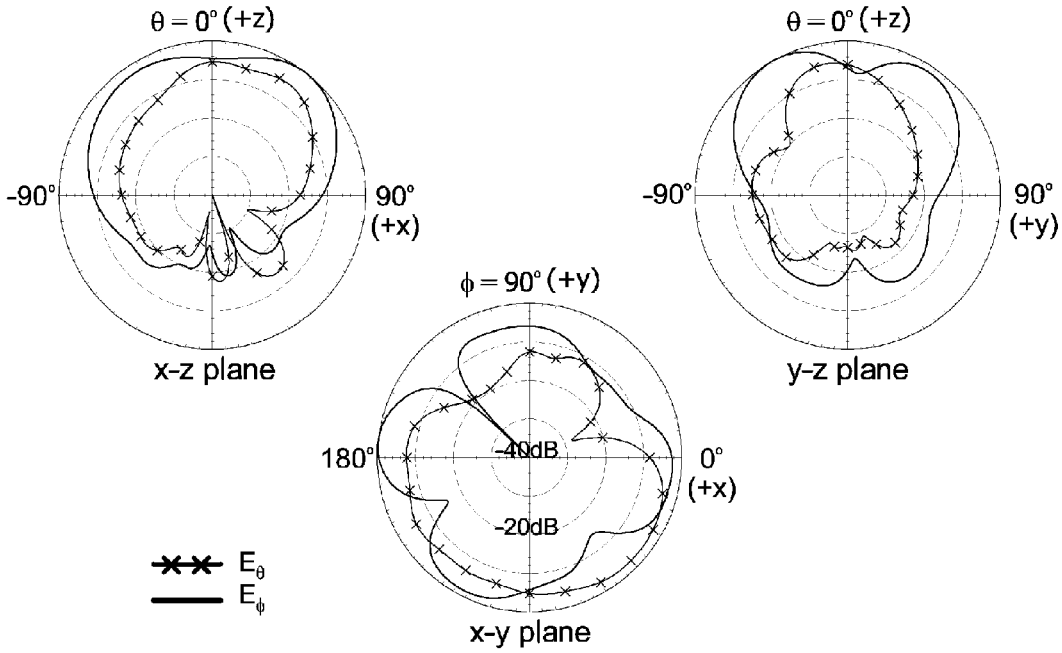
FIG. 10 shows radiation patterns of one dual-loop structure mated with the grounding unit at 5490 MHz in different planes (such as x-z plane, y-z plane and x-y plane) according to the present invention.

Referring to FIGS. 8B and 10, FIG. 10 shows measured results of 2D radiation patterns of one of the dual-loop structures S (the topmost dual-loop structure S in FIG. 8B) at 5490 MHz in different planes (such as x-z plane, y-z plane and x-y plane) according to the definition of the coordinate in FIG. 8B. From the results, directive radiation patterns are respectively shown in elevation planes of the x-z plane and y-z plane.

Figure 11:
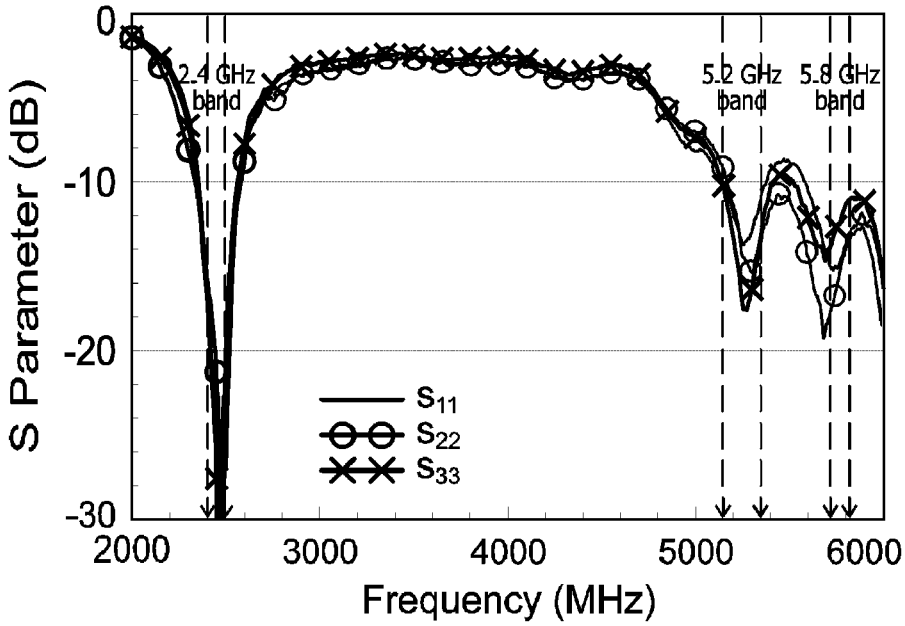
FIG. 11 is a curve diagram of the reflection coefficients (S parameters (dB)) of the dual-loop structures mated with grounding unit against different frequencies (MHz) according to the present invention.

FIG. 11 shows reflection coefficients (S parameters (dB)) of the three dual-loop structures S (such as curves of $S_{21}$, $S_{22}$ and $S_{33}$) against different frequencies (MHz) according to the test results of the three dual-loop structures S as shown in FIG. 8A. The reflection coefficients are lower (under 10 dB) in the 2.4 GHz, 5.2 GHz and 5.8 GHz bands shown in the curve diagram of FIG. 11.

Figure 12:
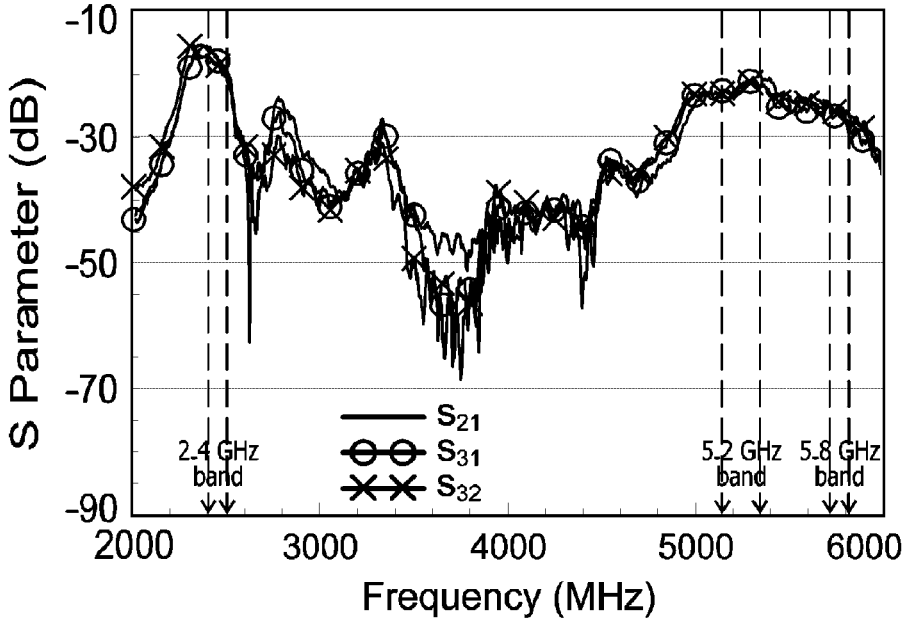
FIG. 12 is a curve diagram of the isolation (S parameters (dB)) between any two of the dual-loop structures mated with grounding unit against different frequencies (MHz) according to the present invention.

FIG. 12 shows the isolation (S parameters (dB)) between any two of the dual-loop structures S against different frequencies (MHz) according to the test results of the three dual-loop structures S as shown in FIG. 8A. In FIG. 12, it is only presented by the curves of S21, S31 and S32. For example, the topmost dual-loop structure S in FIG. 8B is defined by number of 1, and the other dual-loop structures S are defined by number of 2 and 3 in the anticlockwise direction. Hence, S21 refers to the isolation curve between the first dual-loop structure S and the second dual-loop structure S, S31 refers to the isolation curve between the third dual-loop structure S and the first dual-loop structure S, and S32 refers to the isolation curve between the third dual-loop structure S and the second dual-loop structure S. Therefore, the isolations can remain under −15 dB in the 2.4 GHz, 5.2 GHz and 5.8 GHz bands shown in the curve diagram of FIG. 12.

Figure 13:
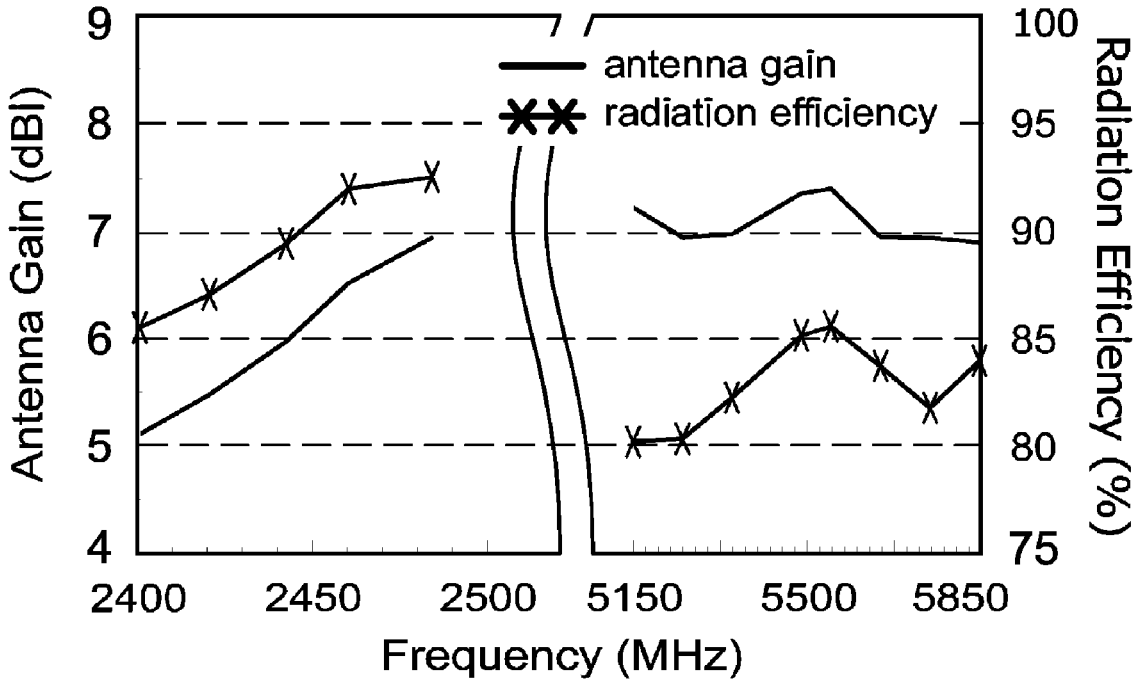
FIG. 13 is a curve diagram of the peak antenna gain (dBi) and the radiation efficiency (%) of one of the dual-loop structure mated with grounding unit against different frequencies (MHz) according to the present invention.

FIG. 13 shows peak antenna gain (dBi) and radiation efficiency (%) of one of the dual-loop structures S against different frequencies (MHz) according to the test results of the three dual-loop structures S as shown in FIG. 8A. In addition, the present invention can take the top surface of the grounding unit 1 as an effective reflector, so that the directivity of the radiation pattern of the present invention is large (the maximum antenna gain about 7 dB is obtained).

In conclusion, the present invention has the following advantages:

1. In the embodiments of the present invention, the present invention uses three independent dual-loop structures S, and each dual-loop structure S is composed of one first loop radiating unit and a second loop radiating unit disposed around the first loop radiating unit. In addition, the first loop radiating unit can operate in the 5.2/5.8 GHz band, and the second loop radiating unit can operate in the 2.4 GHz band.

2. In the embodiments of the present invention, the first loop radiating unit and the second loop radiating unit of each dual-loop structure S can be bent to reduce the whole height of the multi-frequency multi-antenna module of the present invention. Hence, the multi-frequency multi-antenna module of the present invention can be hidden in the antenna system product, such as a router or a hub, so as to enhance the appearance of the product that uses the multi-frequency multi-antenna module.

3. The present invention can obtain good impedance matching (2:1 VSWR or 10 dB return loss) for WLAN operation in the 2.4 and 5.2/5.8 GHz bands by adjusting the distance between the first loop radiating unit and the second loop radiating unit of each dual-loop structure and by controlling the distance between the feeding unit and the shorting unit of each dual-loop structure.

4. Because the shorting unit of each dual-loop structure is adjacent to the feeding unit of each dual-loop structure, the mutual coupling between every two dual-loop structures with different or even the same antenna operating frequencies is substantially decreased and the isolation can remain under −15 dB.

5. Each dual-loop structure can be of a one-wavelength loop structure, which is a balanced structure that can substantially mitigate the surface currents excited on the surface of the antenna grounding plate or system grounding plate. Therefore, the grounding plate such as the grounding unit of the present invention can be act as a reflector, so that the directivity of the antenna radiation is large to obtain high antenna gain (the maximum antenna gain can be about 7 dB).

Figure 14:
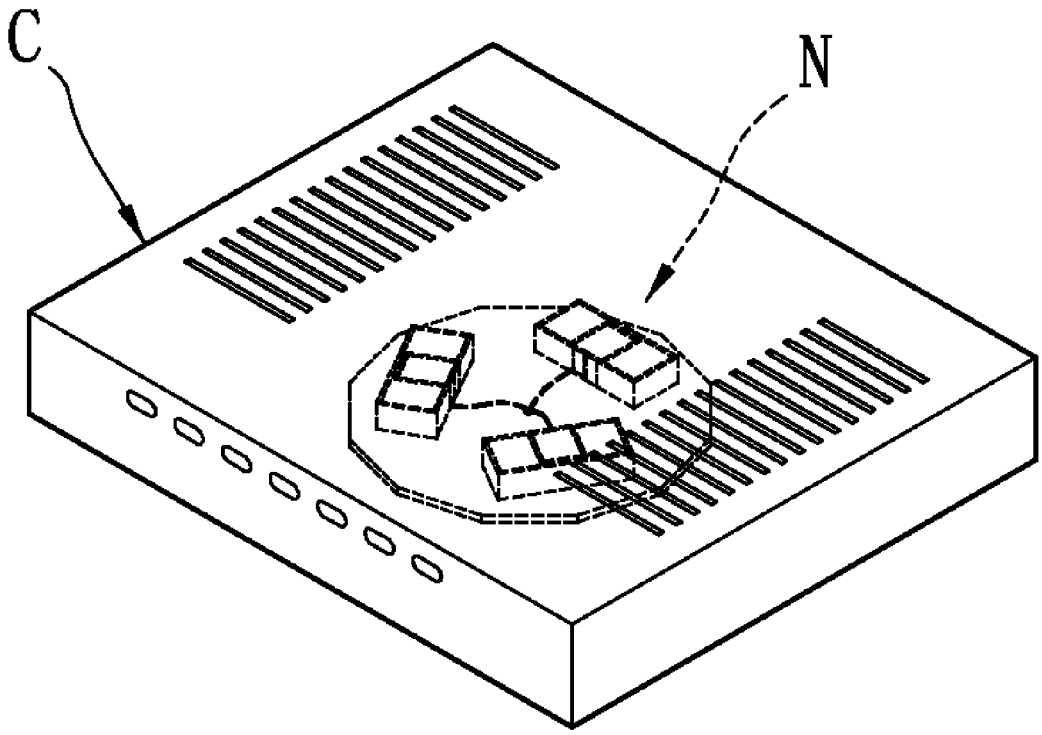
FIG. 14 is a perspective, schematic view of the multi-frequency multi-antenna module installed in an antenna system housing according to the present invention.

Referring to FIG. 14, the multi-frequency multi-antenna module N of the present invention can be installed inside an antenna system housing C (such as an antenna system housing of a router or a hub), for example, the multi-frequency multi-antenna module N can be installed on the internal side of a top cover of the antenna system housing C. In other words, the grounding unit 1 and the three dual-loop structures S are enclosed by the antenna system housing C. Hence, the multi-frequency multi-antenna module N can be hidden in the antenna system product without protruding out of the antenna system housing C, so that the appearance of the product to which the multi-frequency multi-antenna module N is applied can be maintained in a high aesthetic degree and a full degree.

The above-mentioned descriptions merely represent solely the preferred embodiments of the present invention, without any intention or ability to limit the scope of the present invention which is fully described only within the following claims. Various equivalent changes, alterations or modifications based on the claims of present invention are all, consequently, viewed as being embraced by the scope of the present invention.

What is claimed is:

1. A dual-loop antenna, comprising:

a grounding unit;

a shorting unit having at least one shorting pin contacting the grounding unit;

a feeding unit having at least one feeding pin separated from the at least one shorting pin by a predetermined distance and suspended above the grounding unit at a predetermined distance;

a first loop radiating unit disposed above the grounding unit at a predetermined distance, wherein the first loop radiating unit has two ends respectively electrically connected to the shorting unit and the feeding unit, and the first loop radiating unit provides a first operating frequency band; and a second loop radiating unit disposed above the grounding unit at a predetermined distance and around the first loop radiating unit, wherein the second loop radiating unit has two ends respectively electrically connected to the shorting unit and the feeding unit, and the second loop radiating unit provides a second operating frequency band;

a third loop radiating unit disposed above the grounding unit at a predetermined distance, wherein the third loop radiating unit has two ends respectively electrically connected to the shorting unit and the feeding unit, and the third loop radiating unit corresponds to the first loop radiating unit; and a fourth loop radiating unit disposed above the grounding unit at a predetermined distance and around the third loop radiating unit, wherein the fourth loop radiating unit has two ends respectively electrically connected to the shorting unit and the feeding unit, and the fourth loop radiating unit corresponds to the second loop radiating unit;

wherein the first loop unit and the second loop unit are bent along with a line on a plane of the shorting unit and the feeding unit by a certain angle.

2. The dual-loop antenna according to claim 1, further comprising a signal wire, and one end of the signal wire electrically connected to the at least one feeding pin, wherein the grounding unit has a through hole formed on a central portion thereof, and another end of the signal wire passes through the through hole.

3. The dual-loop antenna according to claim 1, wherein the first loop radiating unit has a first radiating portion electrically connected to the feeding unit, a second radiating portion electrically connected to the shorting unit and a third radiating portion electrically connected between one end of the first radiating portion and one end of the second radiating portion, wherein the second loop radiating unit has a fourth radiating portion parallel to the third radiating portion and electrically connected to the feeding unit, a fifth radiating portion extended outwards from the fourth radiating portion and substantially parallel to the first radiating portion, a sixth radiating portion parallel to the third radiating portion and electrically connected to the shorting unit, a seventh radiating portion extended outwards from the sixth radiating portion and substantially parallel to the second radiating portion, and an eighth radiating portion electrically connected between one end of the fifth radiating portion and one end of the seventh radiating portion.

4. The dual-loop antenna according to claim 3, wherein the first, the second, the fifth and the seventh radiating portions are parallel to each other, and the third radiating portion and the eighth radiating portion are parallel to each other and separated from each other by a predetermined distance.

5. The dual-loop antenna according to claim 3, wherein the first radiating portion has a first bending section, and the second radiating portion has a second bending section corresponding to the first bending section, wherein the fifth radiating portion has a fifth bending section, and the seventh radiating portion has a seventh bending section corresponding to the fifth bending section.

6. The dual-loop antenna according to claim 1, further comprising an insulating body disposed on the grounding unit, wherein the shorting unit, the feeding unit, the first loop radiating unit and the second loop radiating unit are tightly adhered to an outer surface of the insulating body.

7. The dual-loop antenna according to claim 1, wherein the first loop radiating unit and the second loop radiating unit are substantially coplanar or non-coplanar.

8. The dual-loop antenna according to claim 1, wherein the first loop radiating unit and the second loop radiating unit are substantially horizontal to the grounding unit.

9. The dual-loop antenna according to claim 1, wherein the first loop radiating unit is divided into two portions by a center line thereof and the two portions of the first loop radiating unit are symmetrical, and the second loop radiating unit is divided into two portions by a center line thereof and the two portions of the second loop radiating unit are symmetrical.

10. The dual-loop antenna according to claim 1, wherein the two ends of the first loop radiating unit are respectively contacted to the shorting unit and the feeding unit, and the two ends of the second loop radiating unit are respectively contacted to the shorting unit and the feeding unit.

11. The dual-loop antenna according to claim 1, wherein the two ends of the first loop radiating unit are respectively contacted to the shorting unit and the feeding unit, and the two ends of the second loop radiating unit are respectively electrically connected to the shorting unit and the feeding unit via the first loop radiating unit.

12. The dual-loop antenna according to claim 1, wherein the two ends of the second loop radiating unit are respectively contacted to the shorting unit and the feeding unit, and the two ends of the first loop radiating unit are respectively electrically connected to the shorting unit and the feeding unit via the second loop radiating unit.

13. The dual-loop antenna according to claim 1, wherein the second loop radiating unit has two opposite sides bent downwards and symmetrically.

14. A multi-frequency multi-antenna module, comprising:

a grounding unit; and a plurality of dual-loop structures surroundingly facing a geometric center of the grounding unit and disposed on the grounding unit, wherein two center lines of every two adjacent dual-loop structures intersect at the geometric center of the grounding unit to form an included angle and each of the included angles has substantial the same measure, and each dual-loop structure comprises:

a shorting unit having at least one shorting pin disposed on the grounding unit;

a feeding unit having at least one feeding pin separated from the at least one shorting pin by a predetermined distance and suspended above the grounding unit at a predetermined distance; and a first loop radiating unit disposed above the grounding unit at a predetermined distance, wherein the first loop radiating unit has two ends respectively electrically connected to the shorting unit and the feeding unit, and the first loop radiating unit provides a first operating frequency band; and a second loop radiating unit disposed above the grounding unit at a predetermined distance and around the first loop radiating unit, wherein the second loop radiating unit has two ends respectively electrically connected to the shorting unit and the feeding unit, and the second loop radiating unit provides a second operating frequency band.

15. The multi-frequency multi-antenna module according to claim 14, further comprising a plurality of signal wires respectively corresponding to the dual-loop structures, and one end of each signal wire electrically connected to the at least one feeding pin of each feeding unit, wherein the grounding unit has a through hole formed on a central portion thereof, and another end of each signal wire passes through the through hole, wherein the feeding unit of each dual-loop structure is adjacent to the shorting unit of one adjacent dual-loop structure, and the shorting unit of each dual-loop structure is adjacent to the feeding unit of another adjacent dual-loop structure.

16. The multi-frequency multi-antenna module according to claim 14, wherein the dual-loop structure is a one-wavelength loop structure.

17. The multi-frequency multi-antenna module according to claim 14, wherein the number of the dual-loop structures is three, and each included angle is 120 degrees.

18. A multi-frequency multi-antenna module installed in an antenna system housing, comprising:

a grounding unit; and a plurality of dual-loop structures surroundingly facing a geometric center of the grounding unit and disposed on the grounding unit, wherein two center lines of every two adjacent dual-loop structures intersect at the a geometric center of the grounding unit to form an included angle and each of the included angles has substantial the same measure, and each dual-loop structure comprises:

a shorting unit having at least one shorting pin disposed on the grounding unit;

a feeding unit having at least one feeding pin separated from the at least one shorting pin by a predetermined distance and suspended above the grounding unit at a predetermined distance; and a first loop radiating unit disposed above the grounding unit at a predetermined distance, wherein the first loop radiating unit has two ends respectively electrically connected to the shorting unit and the feeding unit, and the first loop radiating unit provides a first operating frequency band; and a second loop radiating unit disposed above the grounding unit at a predetermined distance and around the first loop radiating unit, wherein the second loop radiating unit has two ends respectively electrically connected to the shorting unit and the feeding unit, and the second loop radiating unit provides a second operating frequency band;

wherein the grounding unit and the dual-loop structures are enclosed by the antenna system housing.

19. The multi-frequency multi-antenna module according to claim 18, further comprising a plurality of signal wires respectively corresponding to the dual-loop structures, and one end of each signal wire electrically connected to the at least one feeding pin of each feeding unit, wherein the grounding unit has a through hole formed on a central portion thereof, and another end of each signal wire passes through the through hole.

20. The multi-frequency multi-antenna module according to claim 18, wherein the feeding unit of each dual-loop structure is adjacent to the shorting unit of one adjacent dual-loop structure, and the shorting unit of each dual-loop structure is adjacent to the feeding unit of another adjacent dual-loop structure.

* * * * *